US005588266A

United States Patent [19]

Headrick

[11] Patent Number: 5,588,266

[45] Date of Patent: Dec. 31, 1996

[54] CONTINUOUS SIDELIGHT SILL WITH ADAPTABLE THRESHOLD CAPS AND REMOVABLE PAINT SHIELD

[76] Inventor: J. Charles Headrick, 5775 Bethelview Rd., Cumming, Ga. 30130

[21] Appl. No.: 243,259

[22] Filed: May 16, 1994

Related U.S. Application Data

[63] Continuation-in-part of Ser. No. 160,975, Dec. 3, 1993, which is a continuation-in-part of Ser. No. 5,621, Mar. 8, 1993.

[51] Int. Cl.[6] ..... B05C 21/00; E06B 1/70

[52] U.S. Cl. ..... 52/204.1; 49/468; 49/471; 49/467; 118/504

[58] Field of Search ..... 52/204.1, 204.51, 52/207; 49/467, 468, 471; 118/505, 504

[56] References Cited

U.S. PATENT DOCUMENTS

| | | | |
|---|---|---|---|
| 1,697,200 | 1/1929 | Morgana et al. . | |
| 2,078,126 | 4/1937 | Cusick . | |
| 2,290,472 | 7/1942 | Hendrick . | |
| 2,332,579 | 10/1943 | Kirby . | |
| 2,482,977 | 9/1949 | Hendrick . | |
| 3,003,203 | 10/1961 | Grunwald | 49/467 |
| 3,029,782 | 4/1962 | Eure . | |
| 3,083,420 | 4/1963 | Tinflow . | |
| 3,380,435 | 4/1968 | Wagner . | |
| 3,900,967 | 8/1975 | Bursk et al. | 49/468 |
| 4,079,550 | 3/1978 | Bursk et al. | 49/467 |
| 4,193,375 | 3/1980 | Sharland et al. . | |
| 4,258,654 | 3/1981 | Ivankovich | 118/504 |
| 4,341,828 | 7/1982 | Stephens . | |
| 4,352,258 | 10/1982 | Bursk et al. | 49/468 |
| 4,357,898 | 11/1982 | Fehrenbacher . | |
| 4,387,535 | 6/1983 | Corbo | 49/468 |
| 4,398,495 | 8/1983 | Harris, Jr. et al. . | |
| 4,449,267 | 5/1984 | Siemion . | |
| 5,001,865 | 3/1991 | Procton . | |
| 5,102,712 | 4/1992 | Peirce et al. | 118/504 X |
| 5,136,814 | 8/1992 | Headrick | 49/468 X |
| 5,179,804 | 1/1993 | Young | 49/471 |
| 5,230,181 | 7/1993 | Geoffrey et al. . | |
| 5,230,738 | 7/1993 | Wheeler . | |
| 5,283,977 | 2/1994 | Smith . | |

FOREIGN PATENT DOCUMENTS

| | | | |
|---|---|---|---|
| 0667960 | 12/1963 | Canada | 49/467 |
| 2161726 | 1/1986 | United Kingdom | 118/504 |

*Primary Examiner*—Wynn E. Wood
*Attorney, Agent, or Firm*—Hopkins & Thomas

[57] ABSTRACT

A continuous sidelight threshold and door sill assembly for use with entryways having at least one fixed sidelight panel and a hinged door panel comprises an extruded aluminum frame having an elongated channel and a sloped sill. A vertically adjustable threshold cap is shorter than the channel is configured to fit in and be selectively positioned at a predetermined location along the channel. A separate panel cap is also configured to fit in the channel and be selectively positioned therealong. The assembly is universally adaptable to be used either with left handed, right handed, or double sided sidelight door entryways simply by positioning the threshold cap and the panel cap at respective appropriate locations along the channel. A removable paint shield is provided to protect the threshold cap from paint during construction of a building in which the assembly is installed. Also, the threshold and sidelight caps preferably are formed from extruded plastic material and can be easily cut and fitted to virtually any entryway configuration.

8 Claims, 4 Drawing Sheets

CONTINUOUS SIDELIGHT SILL WITH ADAPTABLE THRESHOLD CAPS AND REMOVABLE PAINT SHIELD

REFERENCE TO RELATED APPLICATION

This application is a continuation-in-part of U.S. patent application Ser. No. 08/160,975 filed Dec. 3, 1993, which, in turn, is a continuation-in-part of application Ser. No. 29/005,621 filed Mar. 6, 1993.

TECHNICAL FIELD

This invention relates generally to threshold and door sill assemblies and more particularly to door sill assemblies for installation beneath an entryway having at least one fixed sidelight panel and a hinged door panel. The invention also relates to the protection of door sill threshold caps from paint and other damaging substances during building construction.

BACKGROUND OF THE INVENTION

Decorative entryways into homes and buildings have long been popular among builders and owners alike. In one common configuration of such an entryway, a door that is hinged to be opened and closed is flanked by one or more decorative sidelight panels. In some instances, these sidelight panels are paned with cut or colored glass. In other cases, wooden sidelight panels may be used to flank the door and add dimension and decoration to the entryway. Patio entryways having one fixed door and one openable door hinged either to the left or right of the fixed door are also common. In either case, the common attribute of such entryways is that they include at least one and usually two fixed sidelight panels and at least one hinged door panel.

Providing a reliable and stable threshold and door sill at the bottom of such multi-panel entryway assemblies has proven to be something of a challenge to their manufacturers. In some instances, the entire assembly, including door jambs, door, sidelight frames, and sidelights are built upon a heavy wooden base plate. In these cases, the fixed sidelight panels rest directly on the base plate and are sealed as well as possible in sidelight frames that are formed by the jambs of the assembly. Then, a common wooden or extruded aluminum door sill is installed on the base plate extending between the door jambs beneath the closed door to provide a seal against the bottom of the door.

While this construction technique is somewhat adequate, it nevertheless is plagued with various problems and shortcomings. For example, since the sidelights rest directly on the wooden base plate, rainwater, over time, tends to run down the fixed sidelight panels, seep into the base plate, and cause rotting that eventually necessitates replacement of the entire entryway assembly. The base plate can also warp over time. Further, the aluminum or wooden door sill, which terminates against the bottoms of the door jambs, tends to leak at its ends as rainwater runs down the door jambs and works it way beneath the ends of the sill and onto the wooden base plate below.

Some manufacturers of multi-panel entryway assemblies have addressed these types of problems by purchasing aluminum door sill assemblies long enough to span the entire width of the entryway and underlie both the fixed panels and the hinged door. The sill is then installed along the entire length of a wooden base plate and the door frame, sidelight frames, sidelights, and door are assembled atop the sill. While this approach indeed reduces water seepage beneath the door sill, it too has had numerous inherent problems.

For example, it is desirable with such assemblies that the continuous sill be provided with a vertically adjustable threshold cap positioned to underlie the closed door of the entryway and vertically fixed and structurally sturdy panel caps positioned to underlie the fixed sidelight panels. In the past, such threshold and sill assemblies have by necessity been custom manufactured to fit a particular entryway configuration. This has been due,in part, to the fact that vertical adjustment means of prior art sills have been operatively integrated into the sill frame itself so that the threshold cap is necessarily fixed in a given longitudinal location along the sill. Thus, the threshold cap has been custom cut to length and fitted on the sill frame in the proper location to underlie the closed door. If the size or location of the door changed, new custom sized sill assemblies were necessary to fit the new configuration. In short, prior art continuous threshold and sill assemblies for multi-panel entryways have not been adaptable to changing entryway configurations. This problem has been particularly acute in the case of two door patio entryways. These types of entryways can include either a left-hand swing door or a right-hand swing door. Accordingly, manufacturers have had to stock custom made threshold and sill assemblies with the vertically adjustable threshold cap located both on the left and right of the sill frame. Further, different sizes have had to be stocked for different size door panels. Clearly, the inventory expense and waste of stocking so many custom made parts can be substantial.

Some entryway manufacturers have attempted to solve these problems by purchasing threshold and sill assemblies having a vertically adjustable threshold cap extending the entire length of the sill frame. The threshold cap is then cut into appropriate length sections and the sections that are to underlie the fixed sidelight panels are permanently vertically adjusted before the fixed sidelight panels are installed and sealed in place. While this approach provides a bit more adaptability and reduces the need for custom manufactured sill assemblies, it nevertheless is labor intensive and relatively expensive since an adjustable threshold cap must be paid for even for use under fixed sidelight panels where adjustment is not required.

Another persistent problem with door sill and threshold assemblies of all kinds relates to the protection of the threshold cap and the back or interior side of the assembly from paint and other destructive substances as well as from physical scuffing during construction of a structure in which the sill assembly is installed. In most instances, the sill assembly is installed early in construction prior to the installation of sheetrock, prior to floor finishing, and prior to painting. As a result, the sills, and particularly their threshold caps, often become covered with paint, scraped and scuffed, and generally defaced during the completion of construction. It is not uncommon that a contractor has to replace the threshold cap with a new one after construction is complete. Some contractors attempt to protect the threshold caps by applying tape over them. However, this approach is far from satisfactory since the tape tends to tear and come off during construction. Even where the tape stays on, it tends to stick to the cap and leave an unsightly residue when finally removed. As a result, the threshold cap is often destroyed, even when protective tape is applied.

It can thus be seen that there exists a continuing and heretofore unaddressed need for a continuously running door sill and threshold cap assembly for use with sidelight and patio entryways that eliminates the need for custom sized assemblies by having both vertically fixed and vertically adjustable threshold caps that can be positioned anywhere along the length of the sill frame and thus that are fully adaptable to a wide variety of entryway sizes and configurations. The assembly should be economical to produce, easy to adapt in the field, and provide for superior drainage of rainwater away from both the fixed sidelight panels and the hinged door panel. A further need exists for a reliable, inexpensive, and convenient method and device for protecting threshold caps of door sill assemblies from paint and other destructive substances and from general scaring, scraping, and scuffing during construction of a building in which the door sill assembly has been installed. It is to the provision of such a threshold and door sill assembly and paint shield that the present invention is primarily directed.

SUMMARY OF THE INVENTION

Briefly described, the present invention, in one preferred embodiment thereof, comprises a continuously extending, fully adaptable threshold and door sill assembly for installation in entryways having at least one fixed sidelight panel and an openable hinged door panel. The assembly comprises an elongated extruded aluminum frame formed with an elongated upwardly open channel and a sill that slopes away and downwardly from one side of the channel. An extruded plastic threshold cap is sized and configured to be received and supported within the channel with at least a portion of the threshold cap protruding upwardly from the channel. The threshold cap has a length less than the length of the channel and can be slid longitudinally within the channel to any desired position therealong. The threshold cap is vertically adjustable at any selected location within the channel and is adapted to rest beneath the hinged door of an entryway when the door is closed.

At least one separate panel cap, which also preferably is formed from extruded plastic, is sized and configured to fit in the channel and protrude upwardly a predetermined distance therefrom. The panel cap is fixed in vertical height and, like the threshold cap, can be slid longitudinally within the channel to any desired location therealong. When installed in an entryway, the panel cap is positioned beneath a fixed sidelight panel or beneath the fixed door of a patio entryway, which rests on the panel cap and is sealed in place within a sidelight panel frame.

The upwardly open channel formed in the aluminum frame is generally U-shaped, having a floor and spaced front and rear walls that extend upwardly from the floor. The walls terminate in upper rims. Both the threshold cap and the panel cap are formed with downwardly extending lips that overlap the front wall rim and extend downwardly toward the sloped sill of the assembly. In this way, rainwater is kept out of the channel and directed away from the door and sidelight panels by the overhanging lips of the threshold and panel caps.

In use, the threshold and sill assembly of this invention is extremely versatile because of its easy adaptability to just about any entryway configuration. An entryway manufacturer need only stock the basic aluminum sill and a variety of different length threshold and panel caps. To create a threshold and sill for a particular entryway configuration, the manufacturer simply selects the proper size threshold and panel caps, snaps them into the sill channel, and positions them at the appropriate longitudinal positions along one channel. If necessary, the extruded plastic caps can be cut to length to conform to virtually any entryway configuration. Further, in entryways with only one sidelight, the manufacturer need not stock both left handed and right handed sill assemblies. This is because the threshold and panel caps of the present invention can be slid to any desired position along the channel to create either a right or left handed sill with the very same parts.

This invention also incorporates a paint shield for protecting the threshold cap of a door sill assembly from paint, scrapes, scuffs, and general damage during construction of a building in an entryway of which the sill has been installed. The paint shield comprises an elongated relatively thin plastic cover having a top with front and rear legs that depend from the top along its front and rear edges respectively. The cover is adapted to fit over the threshold cap with its top covering the upper surface of the cap and with its front and rear legs covering the front of the cap and the back of the sill assembly respectively. An elongated tab depends from the underside of the top of the paint shield intermediate the front and rear legs and extends along the length of the cover. The tab is sized and positioned to be inserted between the threshold cap and the wall of the sill channel in which the cap is supported. The tab fits snugly between the cap and channel wall to hold the paint shield in place covering the threshold cap. During construction of a building in which the sill is installed, the paint shield protects the threshold cap and the back of the sill assembly from paint, varnish, scuffs, scrapes, and other damage commonly prevalent at construction sites. When construction is complete, the paint shield is simply grasped with pliers or the like and pulled away from the sill to reveal the clean protected threshold cap beneath. The paint shield can then simply be discarded.

Thus, the present invention embodies an improved threshold and sill assembly for installation beneath sidelight or patio entryways that addresses and solves the problems inherent in the prior art. Specifically, with this invention, the need to stock custom manufactured parts is eliminated because the present invention is fully adaptable to virtually any entryway configuration. It is inexpensive to manufacture, economical to stock, and easy to use. Superior rainwater drainage is an added benefit. The invention also contemplates a paint shield that protects the threshold cap during construction of a building in which the sill is installed. These and many other objects, features, and advantages of the present invention will become more apparent upon review of the detailed description set forth below taken in conjunction with the accompanying drawings, which are briefly described as follows.

DETAILED DESCRIPTION OF THE PREFERRED EMBODIMENT

Figure 1:
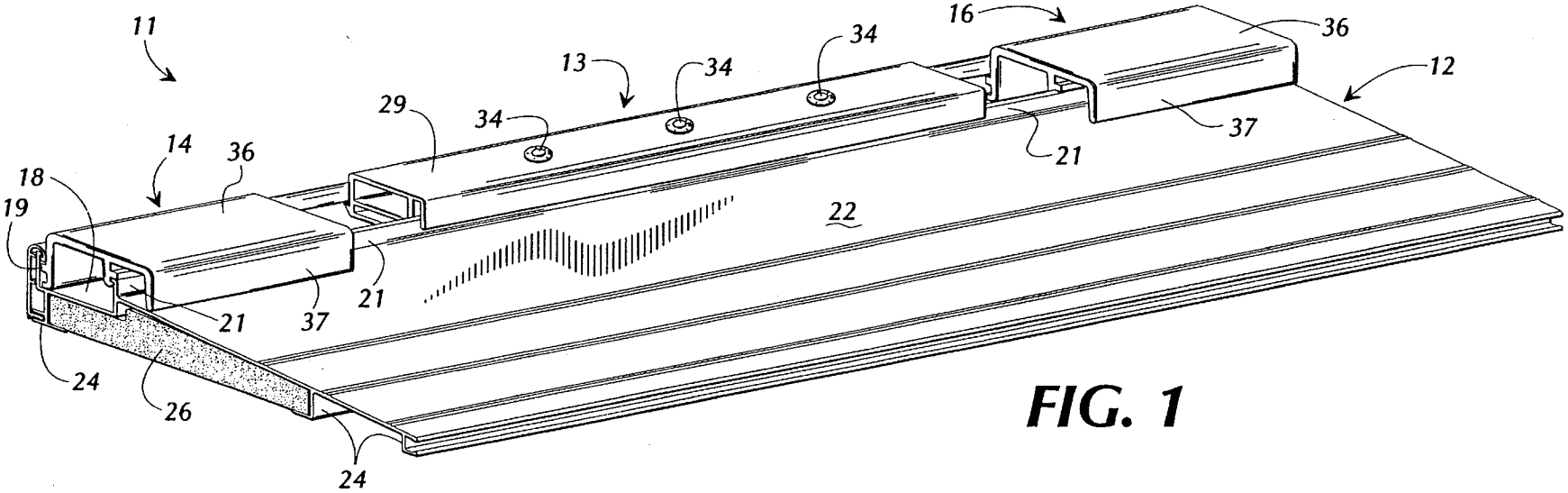
FIG. 1 is a perspective view of a sidelight threshold and sill assembly that embodies principles of the present invention in a preferred form.
Figure 2A:
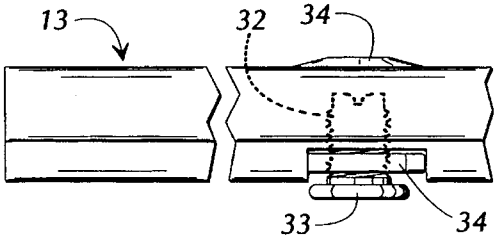
FIG. 2A is a front elevational view of the threshold cap of this invention showing the vertical adjustment means thereof.
Figure 2:
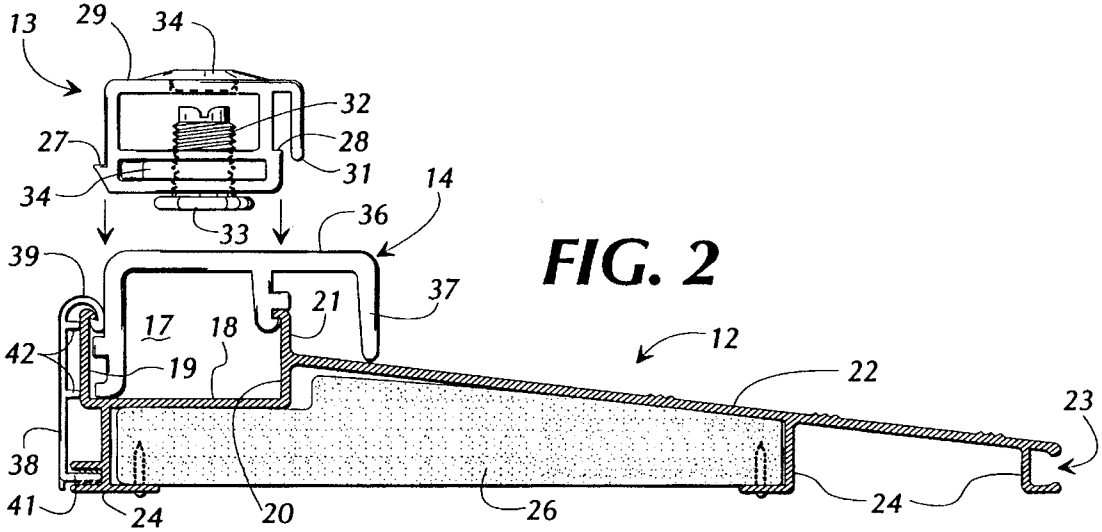
FIG. 2 is a side elevational view of the assembly of FIG. 1 showing the channel, sloped sill, panel cap, and vertically adjustable threshold cap.

Referring now in more detail to the drawings, wherein like numerals refer to like parts throughout the several views, FIGS. 1–2A illustrate a threshold and door sill assembly that embodies principals of the present invention in a preferred form. The assembly 11 is intended for use as the threshold and door sill of a double sidelight entryway having a hinged door flanked by fixed sidelight panels. The assembly comprises an elongated extruded aluminum frame 12, a threshold cap 13, and panel caps 14 and 16, respectively. Frame 12 is formed to define a substantially U-shaped upwardly open channel 17 (FIG. 2) having a floor 18, a rear wall 19, and a forward wall 21. The frame is further formed to define a sill 22 that extends forwardly and slopes downwardly from the forward wall 20 of the channel 17. The sill 22 terminates in a forward edge 23. The entire frame 12 rests and is supported upon a set of depending pads 24. Rigid plastic blocks 26 are secured in place on the underside of the frame as shown to add strength and rigidity to the structure.

The threshold cap 13, which, in use, underlies the hinged door of the entryway when the door is closed, preferably is formed of extruded plasticized material that is aesthetically pleasing yet resistant to wear, tear, warping, and rotting. The threshold cap is configured to have an elongated body that is sized and shaped to fit snugly but removably into the channel 17 defined by the frame 12 as best seen in FIG. 1. Specifically, the upper edges of channel walls 19 and 20 are formed with slightly inwardly extending tangs and the threshold cap 13 is formed with corresponding outwardly extending ledges 27 and 28 (FIG. 2). The ledges 27 and 28 are formed with downwardly tapered upper surfaces as seen in FIG. 2. With this configuration, the threshold cap 13 can easily be snapped downwardly into place in the channel 17 where it is held snugly by the ledges 27 and 28, resting under the tangs of the channel. However, if it becomes necessary to remove the threshold cap 13 once the assembly is in place in an entryway, the cap can be grasped firmly with an appropriate tool and pulled upwardly. When this is done, the sloped upper surfaces of the ledges 27 and 28 engage the tangs of the channel and cause the channel walls to spread enough to allow the removal of the cap 13. A new cap can then simply be snapped into place. Thus, the entire threshold cap can easily and conveniently be replaced in the field if it becomes damaged or otherwise requires replacement.

The threshold cap 13 is further configured to have a top surface 29 and a downwardly extending lip 31 that is formed integrally with the body of the threshold cap and depends downwardly from the front edge of its top surface 29. With this configuration, it can be seen from FIG. 1 that when the threshold cap 13 is positioned within the channel 17, at least a portion of the threshold cap protrudes upwardly from the channel. Further, when thus positioned, the depending lip 31 of the threshold cap overhangs the rim 21 of the channel's forward wall 20 and extends downwardly toward the surface of the sill 22. In this way, rain water and other moisture that may collect or run onto the threshold cap 13 is directed over the lip 31 and onto the sill 22, where it flows down the sill and away from the entryway. Thus, the rim 21 and lip 31 together form a substantially impervious dam that resists the migration of water into the channel 17 where it might collect and do damage.

The threshold cap 13 is vertically adjustable within channel 17 by means of a set of threaded pedestals 32 that depend from the bottom of the threshold cap and terminate in support pads 33. The pedestals 32 are each threadably received in a corresponding threaded lug 34 that, in turn, is captured in a slot cut in the bottom of the threshold cap 13 as best seen in FIG. 2A. The upper end of the pedestals 32 are slotted so that the pedestals can be advanced into and out of their respective lugs 34 to raise and lower the vertical position of the threshold cap within the channel 17. To facilitate such adjustment, the top surface 29 of the threshold cap has access ports that are aligned with the pedestals 32 to allow appropriate adjustment with a screwdriver from the top of the threshold cap. The access ports normally are covered with caps 34, which prevent the migration of water and dirt through the access ports and into the interior portion of the threshold cap 13.

With the just described configuration, it can be seen that the threshold cap 13 rests in the channel upon the support pads 33 and the vertical position of the threshold cap within the channel can easily be adjusted by removing the caps 34 and threadably advancing or retarding the pedestals 32 as required to achieve the proper vertical position. In practice, the vertical position of the threshold cap 13 is such that the top surface 29 of the threshold cap engages a rubberized or metal flap on the bottom of the hinged door to create a seal against the escape of heat from within a dwelling through the entryway. Further, since the threshold cap 13 rests upon pedestals 32, there is no requirement that the threshold cap be located at any given position along the length of the channel 17. Rather, it freely can be slid along the channel to any desired location to adapt the assembly 11 to any particular door and sidelight size and arrangement.

The threshold cap 13 is flanked in the channel 17 by a pair of panel caps 14 and 16 respectively. When the assembly 11 is installed in a sidelight type entryway, the panel caps 14 underlie and support the sidelights. As with the threshold cap 13, the panel caps 14 and 16 are formed of extruded plasticized material and are shaped, as seen in FIG. 2, to snap in place within the channel 17. Also like the threshold cap 13, the panel caps 14 and 16 can be located at any desired longitudinal position along the length of the channel 17. As detailed more fully below, this positionability enhances the adaptability of the assembly 11 a wide variety of or changing entryway designs.

Each of the panel caps 14 and 16 is formed with a top surface 36 having a front edge from which a downwardly depending lip 37 extends. As with the threshold cap, the lip 37 in conjunction with the rim 21 of the channel front wall 20 forms a substantially impervious dam that directs rain water away from and prevents it from migrating into the channel. The panel caps 14 and 16 are not vertically adjustable but, instead, rests on the floor of the channel and the rim of its forward wall to provide a firm support on which the sidelight panels of the entryway can rest and against which they can be sealed to prevent the escape of heat from a dwelling.

In cold weather conditions, the aluminum frame 12 of the assembly 11 can conduct the cold to the rear wall 19 and rear pedestal 24 of the assembly on the inside of a dwelling structure where warm moist air usually is present. To prevent consequent condensation of moisture from the interior of the dwelling on exposed surfaces of the frame 12, a plastic moisture barrier 38 is configured to snap in place covering the interior exposed surfaces of the frame as best seen in FIG. 2. The moisture barrier 38 has a top lip 39 that overlies the top edge of the channels rear wall 19. At the bottom of the moisture barrier 38 is an inwardly extending tang 41 that is received in a corresponding slot of the rear pedestal 24. Thus, the moisture barrier 38 snaps into place with its top edge 39 covering the top edge of wall 19 and its tang 41 pressed into the channel provided in rear pedestal 24. The moisture barrier is formed with a pair of stand-offs 42 that rest on the rear wall 19 of the channel. These stand-offs maintain the moisture barrier in spaced relationship with the rear of the frame 12 to provide a substantially sealed air space between the moisture barrier and the rear of the frame. This sealed air pocket, in turn, functions efficiently to eliminate any condensation of moisture on the back of the frame and thus eliminates any risk of rotting or warping of adjacent wooden structures as a result of the condensed moisture.

In use, the threshold and sill assembly 11 usually is installed as an integral part of a sidelight entryway. When so installed, the assembly extends continuously beneath the entire entryway with the panel caps 14 and 16 underlying the fixed sidelight panels of the entryway and the adjustable threshold cap 13 underlying the closed hinged door of the entryway. With this single continuous sill arrangement, junctions where leakage of water can occur are drastically reduced and water is efficiently shed away from the entryway by the continuous sill and the threshold and sidelight caps.

More importantly, however, the arbitrary positionability of the threshold cap and sidelight caps along the length of the channel 17 renders this threshold and sill assembly highly adaptable to virtually any entryway configuration that includes at least one fixed panel and at least one hinged door panel. For example, the illustration of FIG. 1 shows the assembly configured for use with a double sidelight panel entryway. However, the assembly could be adapted in minutes to be installed in an entryway with a fixed door panel on one side of the entry and a hinged door panel on the other side. This adaptation is accomplished simply by sliding the threshold cap to the end of the assembly where the hinged door is located and placing the appropriate length panel cap on the other end of the assembly. Left-hand and right-hand patio door configurations are equally accommodated simply by moving the respective caps to the proper positions along the channel 17.

Thus, a manufacturer of sidelight and patio entryway assemblies need only stock the basic extruded aluminum frame 12 and standard or stock lengths of threshold and panel caps. If the size or configuration of an entryway changes in the course of construction, the manufacturer need only select or cut the proper length threshold and panel caps, snap them into the channel, and position them on the assembly in the appropriate location to adapt the threshold and sill to the changed entryway configuration. This adaptability represents a significant improvement over prior art systems, which generally require a custom made threshold and sill assembly for each different entryway configuration to be constructed.

Figure 3:
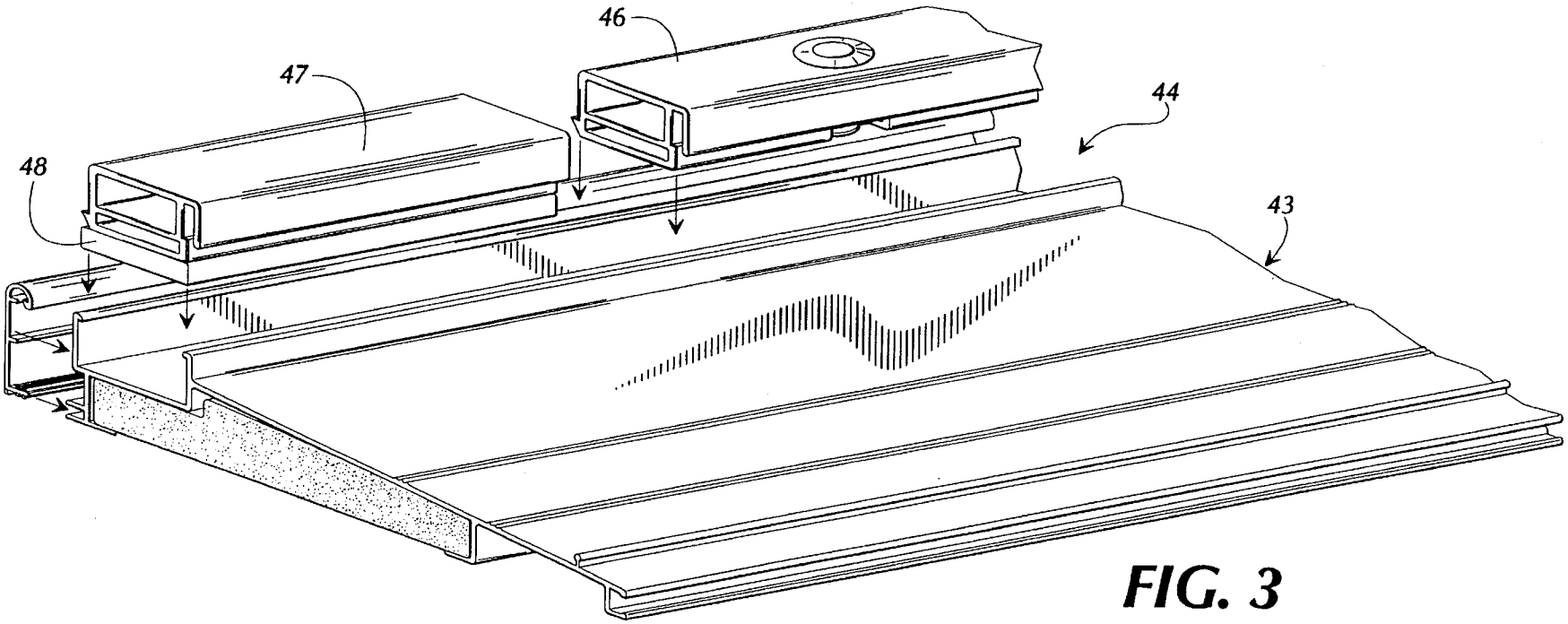
FIG. 3 is a perspective view of the end of a threshold and sill assembly that embodies principles of the invention in a second form.
Figure 4:
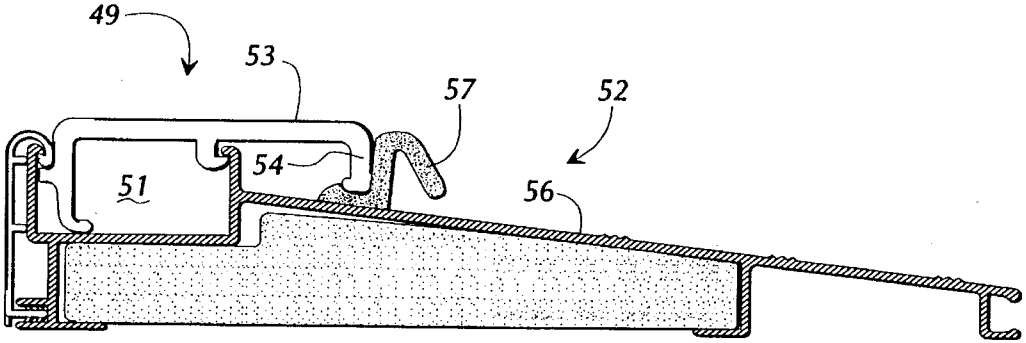
FIG. 4 is an end elevational view of an out-swing threshold and sill assembly that also bodies principles of the present invention.

FIGS. 3 and 4 illustrate slightly different embodiments of the present invention for use with various other entryway configurations. FIG. 3 shows the end portion of a threshold and sill assembly for use with a patio door entryway having one fixed door adjacent to a swinging door. The assembly has an extruded aluminum frame 43 defining a channel 44 into which a threshold cap 46 and panel cap 47 are received. The frame 43 and threshold cap 46 in this embodiment are identical to those of the embodiment shown in FIG. 1. However, the panel cap 47 here has the same general configuration as the threshold cap 46 but lacks the vertical adjustment pedestals thereon. Instead, the panel cap 47 is provided with a pad 48 that is adhesively fixed to the bottom of the panel cap and rests on the floor of the channel 44. In this way, the panel cap 47 provides a firmer foundation to support the added weight of the fixed patio door that rests on the panel cap 47. Further, the panel cap 47 and threshold cap 46 are aesthetically identical so that, when the hinged patio door is closed, there is no perceptible difference between the threshold cap that underlies the fixed door and the threshold cap hinged door. As mentioned above, this embodiment of the present invention is completely adaptable to left and right-hand swing patio doors as well as to patio door entryways of virtually any size and shape. Specifically, both the threshold and panel caps 46 and 47 can be sized and located at any desired location along the channel 44 to accommodate the particular configuration and size of the entryway with which this embodiment of the invention is to be used.

FIG. 4 illustrates an embodiment of the invention for use with swing-out entryways such as is sometimes encountered with French doors. In this embodiment, the threshold cap 49 is not vertically adjustable but is configured to snap in place within the channel 51 of the assembly 52. When snapped in place, the threshold cap is longitudinally slidable within the channel 51 to be positioned at any desired location thereallong.

The threshold cap 49 is formed with a wide top surface 53 and a depending lip 54 that extends downwardly from the front edge of the top surface 53. The lip 54 extends toward the top surface of the sill 56. A foam weather strip 57 is captured between the bottom of the lip 54 and the sill 56 and is shaped as shown in FIG. 4. With this configuration, the bottom edge of the out-swing doors engages and compresses the weather strip 57 against the lip 54 when the doors are closed to prevent loss of heat through the entryway. Rain water and the like running down the doors falls directly onto the sloped sill 56 and is directed away from the entryway so that it does not seep beneath the threshold and cause damage. As with the previous embodiments, the embodiments of FIG. 4 is fully adaptable to virtually any size and configuration of an out-swing doorway by the simple selection of the proper size threshold caps and the proper positioning thereof along the length of the channel 51.

Figure 5:
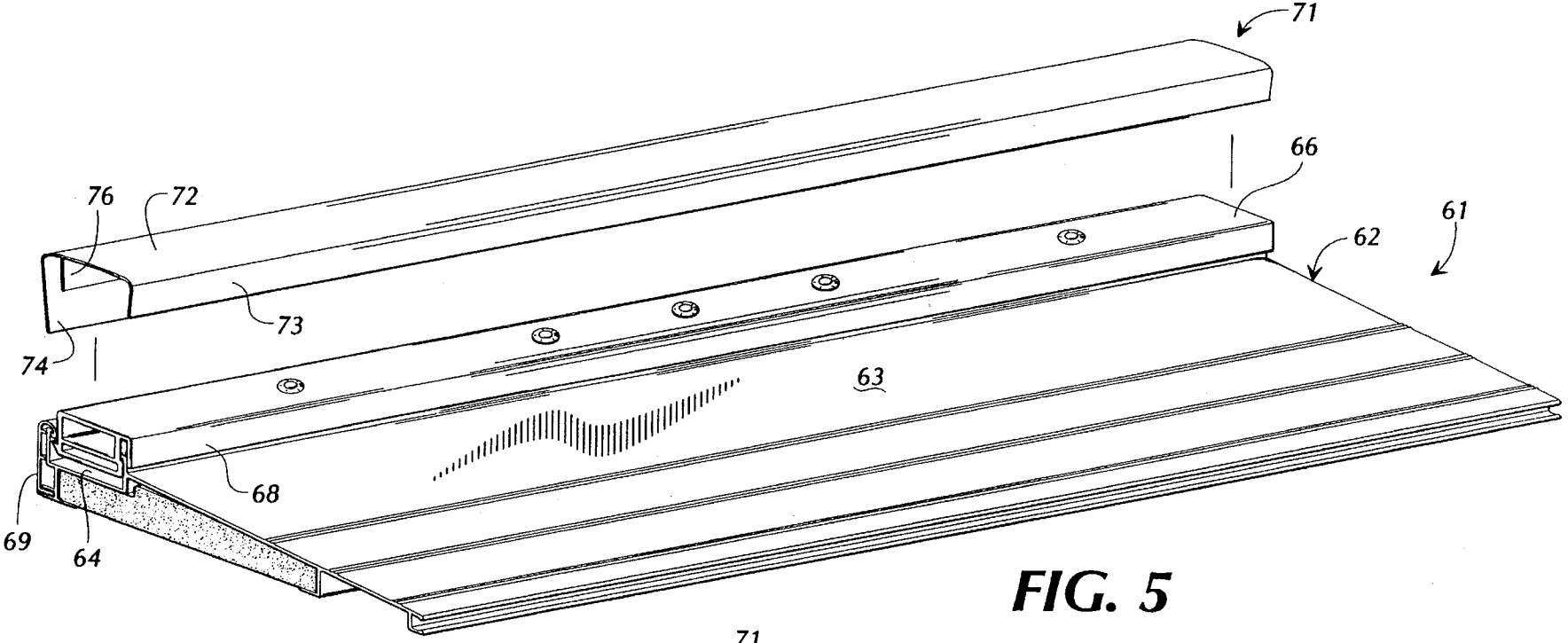
FIG. 5 is a perspective, partially exploded view of a door sill and threshold cap assembly that includes a paint shield embodying principals of this invention.

FIG. 5 illustrates a door sill and threshold cap assembly having a paint shield that embodies principals of the present assembly. The assembly 61 comprises an extruded aluminum frame 62 having a sloped sill portion 63 and an upwardly open rear channel 64. The channel is sized to receive and support an extruded plastic or wooden threshold cap 66. The threshold cap 66 can be of a continuous construction as shown in FIG. 5 or can be a segmented skylight threshold cap as shown in FIG. 1. A continuously running threshold cap is illustrated in FIGS. 5–7 for clarity.

Figure 6:
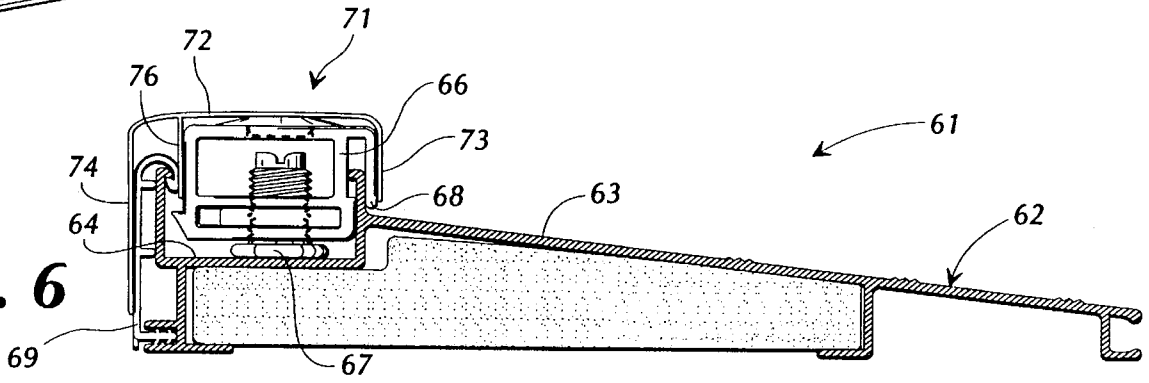
FIG. 6 is a side elevational view of the assembly of FIG. 5 showing the paint shield installed on the sill assembly.
Figure 7:
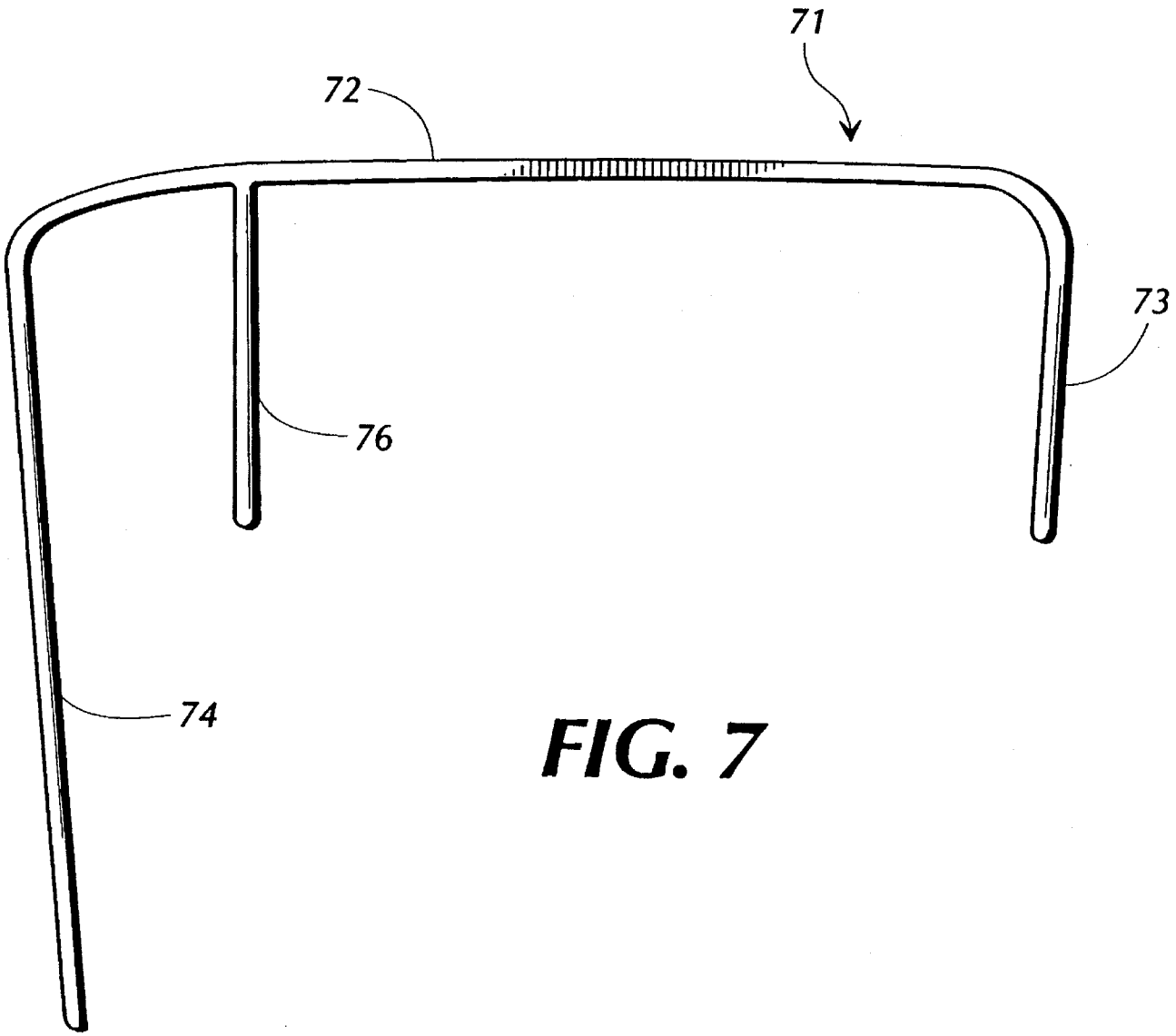
FIG. 7 is an end elevational view of a paint shield fabricated according to this invention.

As best seen in FIG. 6, and as discussed in detail hereinabove, the threshold cap 66 fits into the channel 64 and is supported therein on a set of adjustable pedestals 67. A front lip 68 of the threshold cap drapes over and covers the front wall of the channel 64. As with previously discussed embodiments, a moisture barrier 69 is attached to the back end or interior side of the sill assembly 61 to prevent moisture condensation on the inside of a building structure.

A paint shield 71 is adapted to fit over and protect the threshold cap 66 from paint, solvents, scrapes, and other damaging elements. The paint shield 71 is preferably formed of a relatively thin extruded plastic material. The shield 71 is shaped generally as an elongated inverted channel having a top portion 72, a front leg 73 depending from the front edge of the top portion, and a rear leg 73 depending from the rear edge of the top portion 72. As best seen in FIG. 6, the shield 71 is sized and configured to fit over the threshold cap 66 with the top portion 72 of the shield covering the upper surface of the threshold cap, the front leg 73 covering the front lip 68 of the threshold cap, and the rear leg 74 extending over and covering the moisture barrier 69 on the back of the door sill assembly. In this way, the threshold cap and the moisture barrier are covered and protected by the paint shield 71 as long as the shield is in place on the assembly.

An elongated tab 76 depends from the underside of the paint shield top 72 and extends along the length of the shield. The tab 76 is transversely positioned intermediate the front leg 73 and the rear leg 74. As best seen in FIG. 6, the tab 76 is positioned to fit in the crevice between the threshold cap 66 and the clip portion of the moisture barrier 69 within the channel 64 that supports the threshold cap. The tab could also simply fit in the crevice between the cap and channel wall where no moisture barrier is present. The thickness of the tab 76 is predetermined to fit snugly in the crevice so that it is removed only through application of deliberate upward force to the paint shield 71. In this way, the shield 71 is held firmly in place covering the threshold cap 66 and moisture barrier 69 until it is desired to remove the shield.

FIG. 7 is an enlarged end view of the paint shield 71 showing its top portion 72, depending front and rear legs 73 and 74 respectively, and depending tab 76. The left side of the top portion 72 to the left of the tab 76 in FIG. 7 is seen to be bowed slightly downwardly so that the rear depending leg 74 extends slightly inwardly. In this way, the rear depending leg 74 is spread out slightly when the paint shield 71 is installed on the sill assembly to ensure that the rear leg fits tightly against the back of the assembly, does not get snagged, and prevents migration of paint and other substances onto the moisture barrier 69.

In use, the paint shield 72 generally is installed on the door sill assembly as the assembly is constructed and the threshold cap inserted into its channel. The sill assembly can then either be installed in the field in an entryway or installed in a prefabricated entryway as described above. After the entryway has been installed in a building under construction, the paint shield remains in place to protect the threshold cap and moisture barrier from paint, varnish, scrapes, scratches, and other hazards that can destroy the appearance of the threshold cap. When construction of the building is completed, the paint shield is simply grasped with pliers or the like and pulled upwardly away from the threshold cap. This dislodges the tab 76 along the length of the crevice so that the paint shield can be removed completely and discarded. Once removed, the paint shield reveals the protected threshold cap beneath, which appears new and unmarred.

The invention has been described herein in terms of preferred embodiments. It will be obvious to those of skill in this art, however, that various changes or additions could be made to the illustrated embodiments within the scope of the invention. For example, the threshold and panel caps have been described as being formed of extruded plastic. While this construction is preferred, these items could just as well be formed from other appropriate materials so that the invention is not limited to plastic or any other particular material. Also, the detailed structure of the extruded aluminum frame and the threshold and panel caps is preferred but configurations with differing details might function satisfactorily as well. These and other additions, deletions, and modifications might well be made to the illustrated embodiments without departing from the spirit and scope of the invention as set forth in the claims.

I claim:

1. A threshold and door sill assembly with removable paint shield, said assembly comprising:

an elongated frame member having an outside edge portion and an inside edge portion, said member being formed with a longitudinally extending upwardly open channel adjacent and extending along said inside edge portion and a will shaped to provide a surface that extends laterally and slopes downwardly from said channel to a forward lip at the outside edge portion of said frame member;

an elongated threshold cap sized and configured to be received and supported within said upwardly open channel, said threshold cap having an upper surface, a forward surface, and a rear surface;

said threshold cap being disposed and supported in said upwardly open channel with its upper surface projecting from the channel;

an elongated protective cover having to top with a forward edge portion and a rear edge portion, said protective cover being shaped and sized to fit onto said elongated frame member with the top of said protective cover spanning and covering at least said upper surface of said threshold cap within said upwardly open channel;

means for releasably securing said protective cover to said threshold and door sill assembly to protect at least said threshold cap from damage during construction of a building in which said assembly is installed;

said means for releasably securing said protective cover to said threshold and door sill assembly comprising a tab depending from said upper surface or said protective cover with said tab being sized and positioned to extend into a crevice between said threshold cap and a wall of said upwardly open channel in which said threshold cap is supported to hold the protective cover removably in place on said assembly.

2. For use with a threshold and door sill assembly having a threshold cap, a paint shield for protecting at least the threshold cap during construction of a structure in an entryway of which the threshold and door sill has been installed, said paint shield comprising an elongated inverted channel-shaped body having an upper surface, a depending forward leg, a depending rear leg, and means on said body removably securing said paint shield to a threshold and door sill assembly with said body of said paint shield covering and protecting at least a threshold cap of the threshold and door sill assembly, said means for removably securing said paint shield to a threshold and door sill assembly comprising at least one tab projecting from said body with said tab being sized and positioned to be received in a selected crevice of said threshold and door sill assembly to hold said paint shield removably in place.

3. A threshold and door will assembly having a removable protective cover for installation in an entryway of a building structure, said threshold and door sill assembly comprising and elongated body sized to span an entryway, said elongated body having a sill portion and a threshold cap positioned to underlie a closed door mounted in said entryway, said threshold and door sill assembly further comprising a protective cover for covering and protecting at least said threshold cap, said protective cover being configured to conform to the shape of at least said threshold cap and having a tongue projecting inwardly from said protective cover with said tongue being sized and positioned to be removably received in a selected crevice of said elongated body to secure said protective cover removably in place on said elongated body covering and protecting at least the threshold cap thereof.

4. A threshold and door sill assembly as claimed in claim 3 and wherein said protective cover and said inwardly projecting tongue are formed as a unitary plastic extrusion.

5. A threshold and door sill assembly as claimed in claim 4 and wherein said protective cover is formed with a top and depending sides and wherein said tongue depends from said top of said protective cover.

6. An extruded thermoplastic protective cover for protecting a threshold and door sill assembly form damage during construction of a building structure in an entryway of which the threshold and door sill assembly is installed, said extruded plastic cover comprising a body configured to conform to and cover at least a portion of a threshold and door sill assembly and being formed with a tongue projecting inwardly from said protective cover with said tongue being sized and positioned to be removably received in s preselected groove of the threshold and door sill assembly.

7. An extruded thermoplastic protective cover as claimed in claim 6 and wherein the threshold and door sill assembly includes a threshold cap and wherein said cover is configured to cover and protect the threshold cap of the assembly.

8. A protective cover for being releasably secured to a threshold and door sill to protect the threshold and door sill from damage, said protective cover comprising a body contoured to conform substantially to the shape of and to cover at least a portion of the threshold and door sill, and a tab projection from said body and being configured and positioned to be received in a crevice of the threshold and door sill for releasably securing said protective cover to the threshold and door sill.

* * * * *

UNITED STATES PATENT AND TRADEMARK OFFICE

CERTIFICATE OF CORRECTION

PATENT NO. : 5,588,266

DATED : December 31, 1996

INVENTOR(S) : J. Charles Headrick, Robert T. Ellingson, and Michael M. Tull

It is certified that error appears in the above-identified patent and that said Letters Patent is hereby corrected as shown below:

On title page, item [76], should read:

Inventors: J. Charles Headrick, 5775 Bethelview Road, Cumming, GA 30130. Robert T. Ellingson, 1270 River Cove Rd., Social Circle, GA 30279, and Michael M. Tull, 1255 Riverside Drive, Roswell, GA 30076

Signed and Sealed this

Twentieth Day of May, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,588,266
DATED : December 31, 1996
INVENTOR(S) : Headrick et al.

It is certified that error appears in the above-identified patent and that said Letters Patent is hereby corrected as shown below:

Column 10,
Line 15, should read as follows:
-- ...and extending along said inside edge portion and a wall shaped to... --
Line 27, should read as follows:
-- ...an elongated protective cover having a top with a foward... --
Line 62, should read as follows:
-- A threshold and door sill assembly... --

Column 11,
Line 19, should read as follows:
-- ...and door sill assembly from damage... --

Column 12,
Line 5, should read as follows:
-- to be removably received in a preselected groove... --

Signed and Sealed this

Twenty-sixth Day of July, 2005

JON W. DUDAS
*Director of the United States Patent and Trademark Office*